US006027417A

United States Patent [19]

Zoretic et al.

[11] Patent Number: 6,027,417

[45] Date of Patent: Feb. 22, 2000

[54] METHOD FOR IMPROVING GOLF PLAY UTILIZING A GOLF DISTANCE INDICATOR AND STROKE RECORDING DEVICE

[76] Inventors: Marko R. Zoretic; Richard J. Zoretic, both of 524 Cochrane Road S., Hamilton, Ontario, Canada, L8K 3H5

[21] Appl. No.: 09/092,853

[22] Filed: Jun. 8, 1998

[51] Int. Cl.[7] ..... A63B 67/02

[52] U.S. Cl. ..... 473/407

[58] Field of Search ..... 473/407, 150, 473/168, 169, DIG. 26; 434/252

[56] References Cited

U.S. PATENT DOCUMENTS

| | | | |
|---|---|---|---|
| 3,552,290 | 1/1971 | Brechtel | 473/407 |
| 3,805,411 | 4/1974 | Andrew, Jr. | 473/407 |
| 3,949,987 | 4/1976 | Candor | 473/407 |
| 4,505,472 | 3/1985 | Riethmiller | 473/407 |
| 4,655,451 | 4/1987 | Townsley | 473/407 |
| 4,666,156 | 5/1987 | Wakisaka | 473/407 |
| 4,666,157 | 5/1987 | Bodine et al. | 473/407 |
| 4,783,071 | 11/1988 | Tattershall | 473/407 |

*Primary Examiner*—Steven Wong
*Attorney, Agent, or Firm*—Patrick J. Hofbauer

[57] ABSTRACT

A method is provided for golf play over subsequent plays for each selected golf hole of a golf course played. A player estimates the distance and direction of a desired golf stroke with reference to a golf distance indicator and stroke recording device, comprising a plurality of map sheets correlated to the golf holes of the golf course and including for each hole a map depicting an aerial representation, preferably a photograph, of the hole and having a scaled rectilinear grid superimposed thereon. The player records the selected golf club and the landing point of the golf ball for each golf stroke on the respective map sheet. For subsequent rounds of play on each golf hole, the player utilizes the landing points paths of the golf ball and recorded indica of club type, together with the scaled grid to compensate for errors in the golf type selection and golf stroke encountered during previous rounds of play. A golf distance indicator and stroke recording device for use with the method of the present invention is also provided.

21 Claims, 4 Drawing Sheets

51 47

49

45

| | 5 | 10 | 15 | 20 | 25 | 30 | 35 | 40 | 45 | 50 | 55 | 60 | 65 | 70 |
|---|---|---|---|---|---|---|---|---|---|---|---|---|---|---|
| 5 | 7 | 11 | 16 | 21 | 25 | 30 | 35 | 40 | 45 | 50 | 55 | 60 | 65 | 70 |
| 10 | 11 | 14 | 18 | 22 | 27 | 32 | 36 | 41 | 46 | 51 | 56 | 61 | 66 | 71 |
| 15 | 16 | 18 | 21 | 25 | 29 | 34 | 38 | 43 | 47 | 52 | 57 | 62 | 67 | 72 |
| 20 | 21 | 22 | 25 | 28 | 32 | 36 | 40 | 45 | 49 | 54 | 59 | 63 | 68 | 73 |
| 25 | 25 | 24 | 29 | 32 | 35 | 39 | 43 | 47 | 51 | 56 | 60 | 65 | 70 | 74 |
| 30 | 30 | 32 | 34 | 36 | 39 | 42 | 46 | 50 | 54 | 58 | 63 | 67 | 72 | 76 |
| 35 | 35 | 36 | 38 | 40 | 43 | 46 | 49 | 53 | 57 | 61 | 65 | 69 | 74 | 78 |
| 40 | 40 | 41 | 43 | 45 | 47 | 50 | 53 | 57 | 60 | 64 | 68 | 72 | 76 | 81 |
| 45 | 45 | 46 | 47 | 49 | 51 | 54 | 57 | 60 | 64 | 67 | 71 | 75 | 79 | 83 |
| 50 | 50 | 51 | 52 | 54 | 56 | 58 | 61 | 64 | 67 | 71 | 74 | 78 | 82 | 86 |
| 55 | 55 | 56 | 57 | 59 | 60 | 63 | 65 | 68 | 71 | 74 | 78 | 81 | 85 | 89 |
| 60 | 60 | 61 | 62 | 63 | 65 | 67 | 69 | 72 | 75 | 78 | 81 | 85 | 88 | 92 |
| 65 | 65 | 66 | 67 | 68 | 70 | 72 | 74 | 76 | 79 | 82 | 85 | 88 | 92 | 96 |
| 70 | 70 | 71 | 72 | 73 | 74 | 76 | 78 | 81 | 83 | 86 | 89 | 92 | 96 | 99 |
| 75 | 75 | 76 | 76 | 78 | 79 | 81 | 83 | 85 | 87 | 90 | 93 | 96 | 99 | 103 |
| 80 | 80 | 81 | 81 | 82 | 84 | 85 | 87 | 89 | 92 | 94 | 97 | 100 | 103 | 106 |
| 85 | 85 | 86 | 86 | 87 | 89 | 90 | 82 | 94 | 96 | 99 | 101 | 104 | 107 | 110 |
| 90 | 90 | 91 | 91 | 92 | 93 | 95 | 96 | 98 | 101 | 103 | 105 | 108 | 111 | 114 |
| 95 | 95 | 96 | 96 | 97 | 98 | 100 | 101 | 103 | 105 | 107 | 110 | 112 | 115 | 118 |
| 100 | 100 | 100 | 101 | 102 | 103 | 104 | 106 | 108 | 110 | 112 | 114 | 117 | 119 | 122 |
| 110 | 110 | 110 | 111 | 112 | 113 | 114 | 115 | 117 | 119 | 121 | 123 | 125 | 128 | 130 |
| 120 | 120 | 120 | 121 | 122 | 123 | 124 | 125 | 126 | 128 | 130 | 132 | 134 | 136 | 139 |
| 130 | 130 | 130 | 131 | 132 | 132 | 133 | 135 | 136 | 138 | 139 | 141 | 143 | 145 | 148 |
| 140 | 140 | 140 | 141 | 141 | 142 | 143 | 144 | 146 | 147 | 149 | 150 | 152 | 154 | 157 |
| 150 | 150 | 150 | 151 | 151 | 152 | 153 | 154 | 155 | 157 | 158 | 160 | 162 | 163 | 166 |
| 160 | 160 | 160 | 161 | 161 | 162 | 163 | 164 | 165 | 166 | 168 | 169 | 171 | 173 | 175 |
| 170 | 170 | 170 | 171 | 171 | 172 | 173 | 174 | 175 | 176 | 177 | 179 | 180 | 182 | 184 |
| 180 | 180 | 180 | 181 | 181 | 182 | 182 | 183 | 183 | 186 | 187 | 188 | 190 | 191 | 193 |
| 190 | 190 | 190 | 191 | 191 | 192 | 192 | 193 | 194 | 195 | 196 | 198 | 199 | 201 | 202 |
| 200 | 200 | 200 | 201 | 201 | 202 | 202 | 203 | 204 | 205 | 206 | 207 | 209 | 210 | 212 |
| 210 | 210 | 210 | 211 | 211 | 211 | 212 | 213 | 214 | 215 | 216 | 217 | 218 | 220 | 221 |
| 220 | 220 | 220 | 221 | 221 | 221 | 222 | 223 | 224 | 225 | 225 | 227 | 228 | 229 | 231 |
| 230 | 230 | 230 | 230 | 231 | 231 | 232 | 233 | 233 | 234 | 235 | 236 | 238 | 239 | 240 |
| 240 | 240 | 240 | 240 | 241 | 241 | 242 | 243 | 243 | 244 | 245 | 246 | 247 | 249 | 250 |
| 250 | 250 | 250 | 250 | 251 | 251 | 252 | 252 | 253 | 254 | 255 | 256 | 257 | 258 | 260 |
| 260 | 260 | 260 | 260 | 261 | 261 | 262 | 262 | 263 | 264 | 265 | 266 | 267 | 268 | 269 |
| 270 | 270 | 270 | 270 | 271 | 271 | 272 | 272 | 273 | 274 | 275 | 276 | 277 | 278 | 279 |
| 280 | 280 | 280 | 280 | 281 | 281 | 282 | 282 | 283 | 284 | 284 | 285 | 286 | 287 | 289 |
| 290 | 290 | 290 | 290 | 291 | 291 | 292 | 292 | 293 | 293 | 294 | 295 | 296 | 297 | 298 |
| 300 | 300 | 300 | 300 | 301 | 301 | 301 | 302 | 303 | 303 | 304 | 305 | 306 | 307 | 308 |

FIG.4

METHOD FOR IMPROVING GOLF PLAY UTILIZING A GOLF DISTANCE INDICATOR AND STROKE RECORDING DEVICE

FIELD OF THE INVENTION

The present invention relates to a method for improving golf play, over repeated sessions played at the same golf course, by utilizing a golf distance calculation and stroke recording device.

BACKGROUND OF THE INVENTION

Golfers engage in an ongoing pursuit to improve their game and lower their score. Golfers playing a particular course may take anywhere from 60 to 150 or more shots to complete a round of golf. The goal of any golfer is to improve both the mechanics of his/her golf swing technique and his/her playing strategy in an effort to decrease his/her overall score.

Professional golfers are able to become very familiar with their game, both in terms of how far they can hit a ball using each club, and their stroke accuracy with each of their clubs. Accordingly, a professional golfer will have a repertoire of strokes, adjustments to swing technique, and club types, all of which can be called upon, in combination, in order to respond effectively to the challenges presented by any hole on any golf course. Constant playing, training, and advice from professional caddies or trainers are additionally required to attain this level of skill and experience.

Amateur golfers are not privileged to have equivalent playing and training time and to receive "expert" advice from their playing partners. Therefore, amateur golfers are less likely to be able to systematically recall their particular playing strengths and weaknesses from one round of golf to the next. Moreover, true advancement in honing a golfer's abilities results from repeated practice of the same strokes on the same golf hole to build consistency and reliability. This intensive practice is an arduous process for the amateur golfer who may only play once or twice a month. If repeated play is infrequent, it becomes very difficult to accurately recall previous playing experiences, and the tendency may be for golfers to habitually repeat the same mistakes without realizing it. Instead, if a golfer is able to analyze his/her play to determine what he or she could have done differently after executing a particular combination of golf club type selection and stroke execution, then, over time, the golfer's analysis of his/her game strategy will be improved, as will the consistency of his/her golf swing technique.

A golfer may retain his/her scorecard from previous rounds of golf as a record of his/her play, as a memory aid to previous rounds of play. Typically, scorecards only permit the recordal of the number of shots taken for each hole; they do not provide a means for the golfer to accurately record the distances and other particulars of each shot made on a hole. Accordingly, the amateur golfer lacks a means to compensate for the infrequency of his/her playing opportunities, and to build upon his/her prior playing experiences by developing his/or her skills in response to prior outcomes for each stroke.

Devices are known which will enable a golfer to calculate the distance from the tee to the cup for a particular hole, as a means to assist the golfer in determining how to place his/her shots. U.S. Pat. No. 4,783,071 (Tattershall) is an example of one such device. The Tattershall patent teaches the use of a plurality of schematic aerial representations of the golf holes, upon which are superimposed a plurality of concentric rings radiating out from the position of the cup, in order to provide a indication of the distance from the cup at any particular point on the golf hole, including the tee, the fairway, and the putting green. It is not possible to directly calculate the distance of a shot taken from the tee or some other position unless the ball reached the cup, since the distance determination arcs provide information only with respect to the cup. Tattershall provides a second detailed map of the putting green to provide a more accurate rectilinear grid for distance estimates during putting. The two maps are related to one another by the occurrence on both maps of a single reference point at the edge of the putting green. Thus, to calculate a distance, a player would use the concentric arcs to determine the distance to the reference point, and then use the grid to determine the distance from the reference point to the cup. If the lateral angle of approach of the ball to the putting green is significant (ie. a stroke from the rough, beside the fairway short of the putting green) then the two-part distance determination (to the reference point, and then to the cup), will result in ultimate distances determinations which may be incorrect by 5 yards or more. This inaccuracy, inherent in the use of the Tattershall device, could cause the use of the device to be counterproductive for golfers. If the distance calculation is inaccurate, then a shot which was executed accurately would result in the golfer missing his/her desired target position. This discrepancy would inhibit a player's reliance on his/her instincts relating to swing technique and shot selection, since, inexplicably, he/she would always be doing 'something wrong' to miss the calculated shot. The golfer might then adjust his/her swing technique or other factors in order to 'correct' his/her game, when, in fact, his/her golf stroke had been executed correctly. The effect of this discrepancy would be particularly pronounced for beginning golfers, as they would be more likely to slice or hook their shots laterally rather than along the centre of the fairway. Accordingly, angular shots would occur more often during their play, potentially causing errors in distance calculations to occur more frequently. Moreover, beginning golfers would be more likely to overcorrect their swing technique in response to perceived errors, since they would be less familiar with golf swing techniques generally. Moreover, the Tattershall device does not teach the benefits to be gained from saving the information of a golfer's experience on one round of play to be used to guide future rounds of play.

U.S. Pat. No. 3,805,411 (Andrews, Jr.) teaches a golf score card and true distance indicator using circular arcs spaced at convenient intervals as distance indicators. Although Andrews Jr. does suggest the possibility of determining distances from the tee off position as an alternative to distance calculations relative to the cup position, Andrews does not address the fact that different golfers may tee-off from different locations on the same hole, or may wish to calculate intermediate distances, without relation to either the pin or the cup. Moreover, Andrews Jr. does not suggest the use of the golf score card and true distance indicator as a teaching aid for future development of a golfer's play during subsequent rounds of golf.

Accordingly, it is an object of the present invention to provide a method of improving golf play utilizing a golf distance calculation and stroke recording system.

It is a further object of the present invention to provide a means for a player to track and record club selection, shot placement, and other variables for each hole played on a particular golf course and retain this information in an efficient and accessible manner for future reference.

It is yet a further object of the present invention to provide a method for improving golf play by providing a player with the necessary information, derived from previous rounds of play, to compensate for difficulties previously encountered, so as to improve a golfer's score on the present round of play.

It is a further object of the present invention to provide a method for improving golf play by assisting a player to improve shot characteristics and/or avoid repeating mistakes made during previous rounds of play at a given hole.

It is a further object of the present invention to provide a method for improving golf play by providing a simple to use, yet mathematically accurate means for determining shot distances, both in terms of the distance from the pin and the distance of particular shot taken.

SUMMARY OF THE INVENTION

In accordance with the present invention a method of improving golf play utilizing a distance calculation and stroke recording system is presented. The method comprises the following steps for each selected golf hole of a golf course played: (a) selecting a corresponding map sheet from a plurality of said map sheets being contained within a golf distance indicator and stroke recording device, each said map sheet correlated to the golf holes of a golf course, each said map sheet including, for each golf hole, a first map depicting an aerial representation of a golf hole and having a scaled rectilinear grid superimposed thereon, said grid identifying distances which correspond to true ground distances on said golf hole; (b) estimating the distance and direction of a desired golf stroke with reference to the scaled rectilinear grid superimposed upon the aerial representation of said golf hole; (c) selecting a golf club appropriate to execute a golf stroke from a plurality of golf clubs each of a different type; (d) executing the golf stroke utilizing the selected club and a golf ball; (e)recording the landing point of said golf ball and an indicia of the type of golf club selected to execute the golf stroke of step (d), on the selected aerial representation of the golf hole; (f) repeating steps (b) through (e) until the golf ball is deposited into a cup at a pre-determined pin position on the selected golf hole played; (g) for subsequent rounds of play on the selected golf hole, utilizing the respective recorded landing point of the golf ball, the indica of golf club type selected and used during the previous round of play, in respect of the selected golf hole, and the scaled grid superimposed upon the aerial representation of the selected golf hole, to estimate the distance and direction, and club selection of a subsequent golf stroke, so as to compensate for any errors in the golf club type selection and the golf stroke encountered during previous rounds of play, as evidenced by the recorded golf club type indicia and the landing point of the golf ball from previous rounds of play. The step (b) of estimating the distance and direction of a desired golf stroke further comprises the sub-step (b) (i) of referring to an angular distance calculation means to estimate the distance of golf strokes which are directed at angles which are not parallel to the scaled rectilinear grid superimposed upon the aerial representation of the golf hole.

Other objects, advantages, features and characteristics of the present invention, as well as methods of operation and functions of the related elements will become more apparent upon consideration of the following detailed description and the appended claims, with reference to the accompanying drawings, the latter of which are briefly described hereinbelow.

BRIEF DESCRIPTION OF THE DRAWINGS

FIG. 4 of the drawings is a top plan view of an angular distance calculation means for a golf distance indicator and stroke recording device according to the present invention.

DETAILED DESCRIPTION OF A PREFERRED EMBODIMENT

Figure 1:
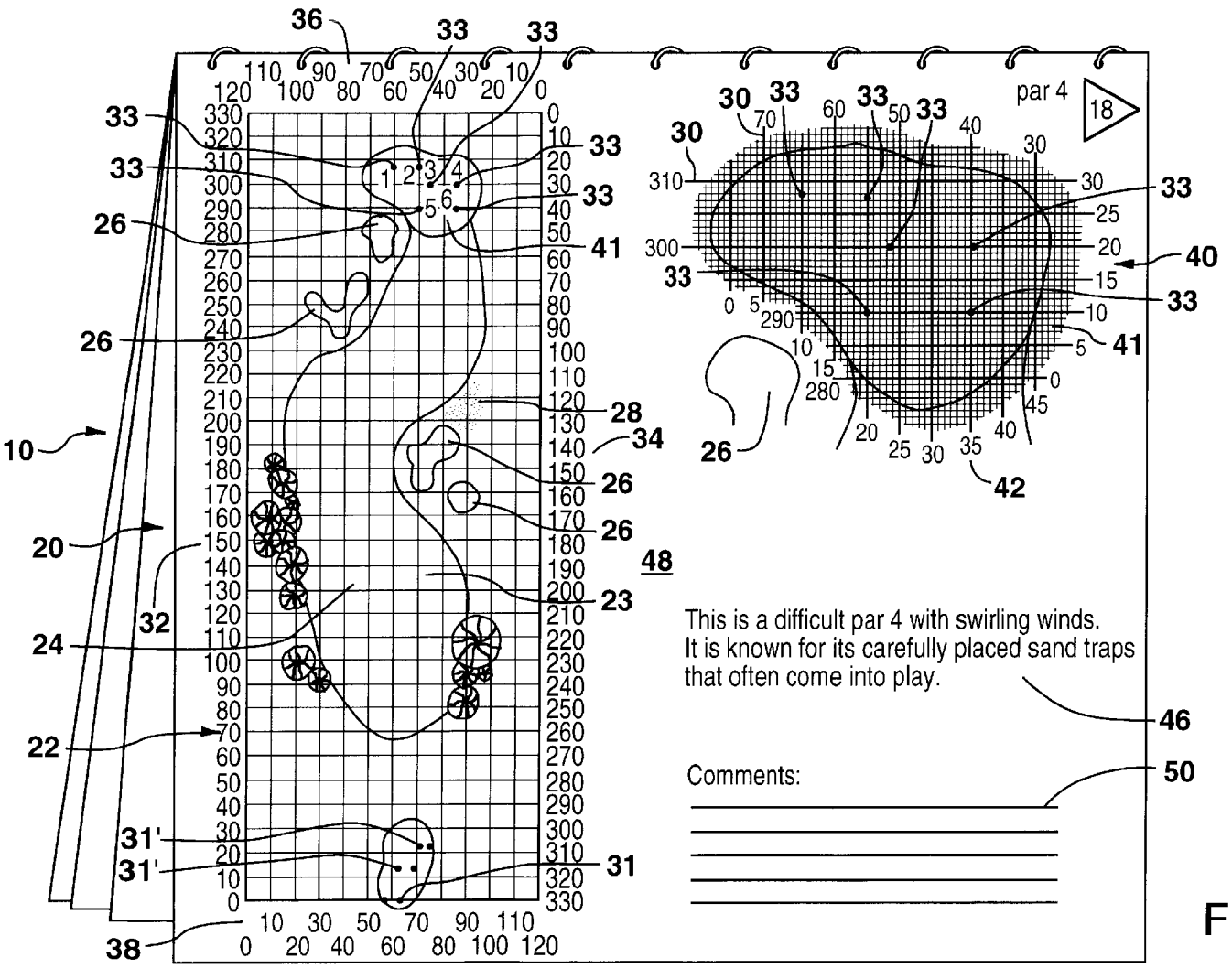
FIG. 1 of the drawings shows a golf distance indicator and stroke recording device according to the present invention, opened to display a top plan view of a map sheet thereof.

Referring to FIG. 1 of the drawings, a golf distance indicator and stroke recording device, according to a preferred embodiment of the present invention, is shown by the general reference numeral 10. Preferably the golf distance indicator and stroke recording device 10 comprises a plurality of map sheets, one of which map sheets is identified in FIG. 1 by the general reference numeral 20. The plurality of map sheets corresponds to a respective plurality of golf holes on a golf course. Each map sheet 20 includes a first map 22 which depicts an aerial representation of the respective golf hole 23.

It is preferred to use an actual aerial photograph of the golf hole 23 as the basis for the map 22. An aerial photo has the advantages of being true in colour and providing a completely accurate representation of the features of the golf hole 23 such as the fairway 24, the sand traps 26, the rough 28, and other features and hazards, and their physical proximity to one another. When actual aerial photos are used as the aerial representations of the golf holes on the map sheets 20, each of the map sheets 20 will be easily differentiated from the remaining map sheets 20 by the colours and features which are clearly and identifiably unique from those shown for any other hole on any golf course. There is no need to interpret sketches containing a set of symbols for hazards, roughs, fairways, etc., as these features are clearly shown on each map sheet 20 in the same general manner as they appear to the eye when viewing the actual features on the golf holes. Thus, the information contained in the aerial photos is more readily and rapidly processed by a golfer, since the information corresponds to the actual visual appearance of the golf hole shown, and does not rely upon the interpretation of a system of graphic symbols. A further advantage to be derived from the use of actual aerial photos is that such photos are taken looking straight down upon the respective golf hole. Each of the maps, so generated, have distances which are kept to scale at all points on the golf hole depicted thereon. The use of aerial photos is further preferable over stylized graphical representations of the golf holes, since aerial photos add elements of interest and realism to the present device which prior art golf scorecards lack. Moreover, the physical features and contours of a golf hole typically do not is change significantly over several years, and the map sheets 20 generated using actual aerial photos could therefore be used over a relatively long period of time. In the subsequent description and claims the inclusive phrase, "aerial representation" of the golf hole, is used in order to be non-limiting; however, it should be understood that the phrase "aerial representation" includes actual aerial photographs, and the use of aerial photographs in the present invention is preferable, for the reasons discussed above.

On the first map 22, a scaled rectilinear grid 30 is superimposed upon the aerial representation of the golf hole 23 to identify distances which correspond to the true ground distances of the golf hole on the golf course. The lines of the scaled rectilinear grid 30 are kept thin and unobtrusive as to minimize the visual interference of the grid 30 with the aerial representation of the golf hole 23. A vertical numbering scale 32 on the left extreme edge of the grid 30 begins at the numerical value "0" positioned to correspond to the tee position 31 on the golf hole 23, and approaches a distance to encompass the entire length of the golf hole 23, which as shown on map 22 is 330 yards. The vertical numbering scale 34 on the right extreme edge of the grid 30 operates in the opposite direction, with the numerical value "0" being positioned at the far end of the golf hole 23 and the full distance of the hole being marked at the tee position 31. The scaled rectilinear grid 30 preferably has a line marking every 10 yards along the golf hole 23. A grid 30 based upon 10 yard intervals provides a simple and convenient means to determine distances on the golf hole. A golfer can use the left vertical numbering scale 32 to determine how far a shot was driven, and then the right numbering scale 34 to determine how far the ball must still travel to reach the cup.

Horizontal numbering scales are also presented both at the top 36 and bottom 38 of the scaled rectilinear grid 30. The top horizontal numbering scale 36 displays the numerical value "0" adjacent the upper right hand corner of the map 22 and progresses to a maximum value to encompass the full width of the golf hole 23, which as shown on map 22 is 120 yards. The bottom horizontal numbering scale 38 displays the numerical value "0" adjacent the lower left hand corner of the map 22 and progresses to a maximum value to encompass the full width of the golf hole 23.

By using the scaled rectilinear grid 30, a golfer can coordinate any actual physical ground location on the golf hole of the golf course with the corresponding position on the aerial representation of the golf hole 23 shown on the map 22. Thus it is possible to use the map 22 and the scaled rectilinear grid 30 to determine the absolute ground distances, such as the distance from the tee 31 to the pin position 33, or from the tee position 31 to hazards such as water, trees, sand traps, etc. The scaled rectilinear grid 30 can also be used to determine relative distances with relation to the position of the golf ball anywhere on the golf hole 23. Thus, the grid 30 can be used to aid in calculating the desired placement of a shot, for initial shots from the tee position 31 and for subsequent shots from a landing point anywhere on the golf hole 23.

Typically, a golf hole on a golf course will have a number of supplementary tee positions 31', such as a handicap position and a ladies' tee-position. Each of the supplementary tee positions 31' are also shown on the map 22. Although the left vertical numbering scale 32 is aligned to take "0" valued measurements from the furthest tee position 31, a golfer can determine the relative distances from his supplementary tee position 31' by simply subtracting the distance between their supplementary tee position 31' and the tee position 31 in any calculation using the scaled rectilinear grid 30.

Typically golf courses will have a number of possible pin positions for each golf hole, and will rotate the use of these positions periodically in order to avoid undue wear on the green. The map 22 also has depictions of these pin positions 33 marked thereon, and a golfer can simply determine, prior to starting a game, which pin position 33 is being used by on the golf course on a given day, and make all shot determinations with respect to the desired pin position 33 as a target.

Putting is a major portion of the game of golf. The golf distance indicator and stroke recording device further comprises a second map shown by the general reference numeral 40. The second map 40 depicts an aerial representation of the putting green 41. The second map 40 is an enlarged view of a portion of the first map 22, in order to provide a golfer with a more accurate means for calculating the shorter distances which are encountered on the putting green 41. The second map 40 has two scaled rectilinear grids superimposed upon the aerial representation of the putting green 41, both of which correspond to true ground distances on the putting green 41. The scaled rectilinear grid 30 marked off in 10 yard gradations which appears on the first map 22 also appears on the second map 40. In addition thereto, a second finer scaled rectilinear grid 42, marked off in 1 yard gradations, is also superimposed upon the representation of the putting green 41. The second grid 42 is in synchronization with the first grid 30. The synchronization of the two scaled rectilinear grids 30 and 42 permits a direct "linking" of distances on the two maps 22 and 40. Thus, when a golfer needs to calculate a distance which begins at a position on the fairway 24 or elsewhere and ends on the putting green 41, that portion of the distance which is depicted on the first map 22 can be calculated using the first scaled rectilinear grid 30, and then, for further particularly, the final position on the putting green 41 can be precisely determined using the finer scaled rectilinear grid 42 on the second map 40. There is no translation factor to be applied when switching from map 22 to map 40, since the two maps 22,40 and the two scaled rectilinear grids 30, 42 are calibrated with reference to one another. The information to be gained from using both scaled rectilinear grids is useful even when teeing off. When pin placement is periodically rotated to decrease wear on the putting green, the distance from tee-off to pin changes will change by small, but significant, amounts. By using the two co-ordinate scaled rectilinear grids, a golfer can make a small calculation to adjust for the distance correction to the pin from any position on the main map, including the tee position.

Each map sheet 20 preferably also contains an indication 44 of the particular golf hole to which a given map sheet 20 corresponds. Additionally, each map sheet 20 preferably includes a description 46 of the major features of the particular golf hole.

The map sheet 20 is preferably constructed to have a planar erasable surface 48 upon which markings can be made by the golfer using a marking means such as a grease pen or an erasable felt-tipped marker. The planar erasable surface 48 extends over the entire surface of the map sheet 20, including over the complete surface of both the first map 22 and the second map 40. Thus, a golfer can place indicia on the aerial representation of the golf hole 23 of the relative position of the golf ball on the golf hole of the golf course, in the corresponding position on the appropriate one of maps 22, 40, for future reference, as will be discussed in greater detail below. The erasable nature of the surface 48 permits the golfer to erase information and reuse the golf distance indicator and stroke recording device as desired. Each map sheet 20 additionally provides a space 50 in which a golfer can record written comments respecting his/her impressions of the physical features and/or playing conditions of the golf hole.

Not all distances of interest with respect to the golf hole 23 occur parallel to the scaled rectilinear grids 30 and 42 superimposed upon the respective aerial representations 22 and 40. Distances may need to be calculated to compensate for the angles present in a "dog-leg" portion of a fairway. Similarly, golf strokes which are hooked or sliced may veer off course at some angle which is not in a direction parallel to the grid 30. The golf distance indicator and stroke recording device of the present invention further comprises an angular distance calculation means which can be used to obtain mathematically accurate estimates of distances at angles not parallel to one of the grids 30, 42. As shown in FIG. 4, the angular distance calculation means 45 is preferably in the form of a table containing columns 47 and rows 49 of numerical values which represent the Pythagorean sums of combinations of respective perpendicular and parallel distance vectors. The use, as taught herein, of Pythagorean geometry as the basis to calculate angled distances provides a highly accurate method of calculation, and one which is not dependant upon the position of the ball relative to either the pin or the cup. The following is an example of the manner of use of such an angular distance calculation table 45 which employs Pythagorean sums. If a golf ball was at a position 40 yards to the left of the pin 33 and 50 yards short of the pin 33, a golfer would refer to the table 45 and match the point of intersection of the distances in the respective column 47 and row 49 of the table 45. The number appearing at the point of intersection of the appropriate row 49 and column 47 yards, as identified by reference numeral 51, would be an accurate approximation of the distance of the angular distance. In the present example the distance determined by reference to the table 45 would be 64. For added accuracy, it is preferable to use a chart having columns and rows set in 1 yard intervals for length distances lower than 150 yards.

The present invention is further directed to a method for improving golf play, for each selected golf hole of a golf course played. The method employs the systematic use of the golf distance indicator and stroke recording device, as detailed below with reference primarily to FIGS. 2 and 3.

For each selected golf hole of a golf course played, the golfer will select a corresponding map sheet 20 from a plurality of said map sheets being contained within the golf distance indicator and stroke recording device. Each said map sheet 20 is correlated to a golf hole of the golf course, as discussed in greater detail hereinabove. The golfer will refer to the first map 22 in order to become familiar with the characteristics and distances of the golf hole 23. In so doing, the golfer will estimate the distance and direction of a desired golf stroke by reference to the scaled rectilinear grid 30 superimposed upon the aerial representation of the golf hole 23. The desired stroke would be one which avoids hazards, is within the physical ability of the golfer, and from which a desirable subsequent stroke may be undertaken. The golfer then selects a golf club appropriate to execute the desired golf stroke from a plurality of golf clubs each of a different type, and then executes a golf stroke utilizing the selected golf club and a golf ball. The golfer then records the landing point of the golf ball. The golfer may also choose to record the flight path including the trajectory that the ball took, signifying if it was sliced or hooked, on the aerial representation of the golf hole 23. Examples of such flight paths are indicated by reference numerals 52 through 58 on FIG. 2. This recording step is executed using an erasable drawings means such as a grease pencil or erasable felt-tipped marker. The golfer simply draws the flight path of the golf ball, including the initial landing point, and any bounces or subsequent rolling of the golf ball, on the aerial representation of the golf hole 23 with reference to the scaled rectilinear grid 30, so as to accurately represent the true ground distance of the golf stoke. The recording of flight paths is particularly useful for beginning players, and those who are trying to correct the tendency to hook or slice their shots. Once the golfer is familiar with the use of the present method and device, he/she may choose to record only the landing point, in order eliminate a visual clutter of lines on the map sheet 20.

The golfer would also record an indicia of the type of club selected to execute the golf stroke. This indica can employ any convenient code to identify the club type used. Preferably a simple alphanumeric system will be employed. It is advantageous to simply use a letter selected such as "I", to represent irons, and "W" to represent woods, followed by a number to represent the particular club number within each type. Thus, for example, the alphanumeric indicia for a three wood is "3W" as shown by reference numeral 53 in FIG. 2, a nine iron would simply be "9I" as shown by reference numeral 55.

The golfer would again refer to the scaled linear grid 30 to determine the distance and direction of the next desired stroke, determined from the landing point of the ball after the previous stroke. For example, the flight path 52 from the supplementary tee position 31' landed approximately 195 yards down the fairway, near the edge of the rough at the landing point identified by numeral 57. From the landing point 57, the golfer would determine a desired shot toward the putting green 41, as close as possible to the pin position 33, (this example presumes that a pin position referenced by the golfer on the map 22 as "4" is being used for that day's play). Reference may be made to the angular distance calculation means 45, as needed whenever a distance calculation is not parallel to the grid 30. Thus the golfer would then determine that he/she needed a distance of approximately 95 yards down the fairway and approximately 70 yards across. Reference to the angular distance calculation means 45 would show that a shot of approximately 118 yards at an angle toward the pin position 33 would be desired. The steps of selecting a golf club, executing a golf stroke, and recording the flight path of the ball are repeated for that shot. The indicia of golf club selection 61 shows that an eight iron was used, and as shown reference numeral 59, the landing point of the ball was somewhat short, necessitating a further shot with a pitching wedge onto the putting green.

Figure 3:
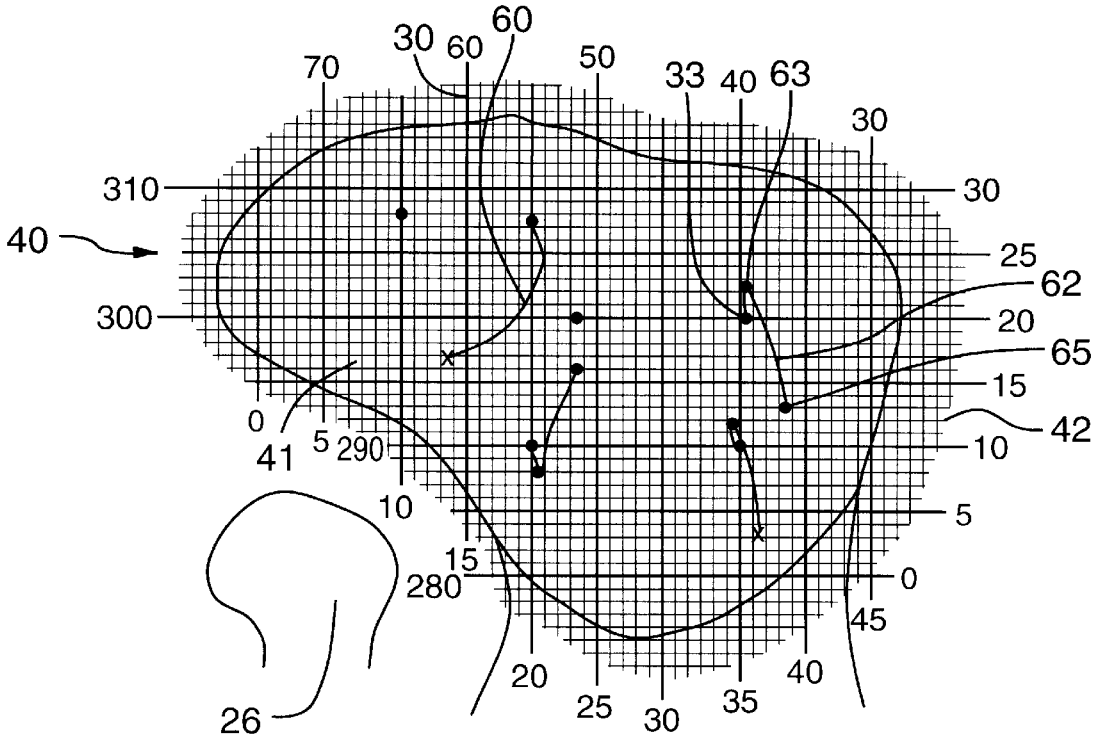
FIG. 3 of the drawings is a partial view of the map sheet of FIG. 1, showing an enlarged view of the corresponding second map depicting an aerial representation of the putting green of the respective golf hole, in use in accordance with the method of the present invention.

Once the ball has landed on the putting green, the golfer can then refer to the second map 40 showing an enlarged aerial representation of the putting green 41, with the finer scaled rectilinear grid 42 superimposed thereon. As shown in FIG. 3, the landing point 65 of the golf ball is marked by the golfer on the second map 40. The golfer then uses the second finer scaled rectilinear grid 42 to estimate the distance and direction of a desired golf putt, and executes the putt using a selected golf club and the golf ball. The golfer will then record the path of the golf ball on the aerial representation of the putting green. As indicated by reference numeral 62, the first putt did not reach the pin 33, but rather landed at the position identified by reference numeral 63, necessitating a further putt. The process of recording the path of the golf ball, calculating a subsequent putt, executing the subsequent putt and recording the subsequent path is repeated until the golf ball is deposited into the cup at the pin position 33.

The golfer can further record written comments regarding the physical features and playing conditions for the round of play in the space provided on the map sheet 20. An example of relevant comments would be that the putting green slopes to the right and the golf ball tended to roll past the cup.

Figure 2:
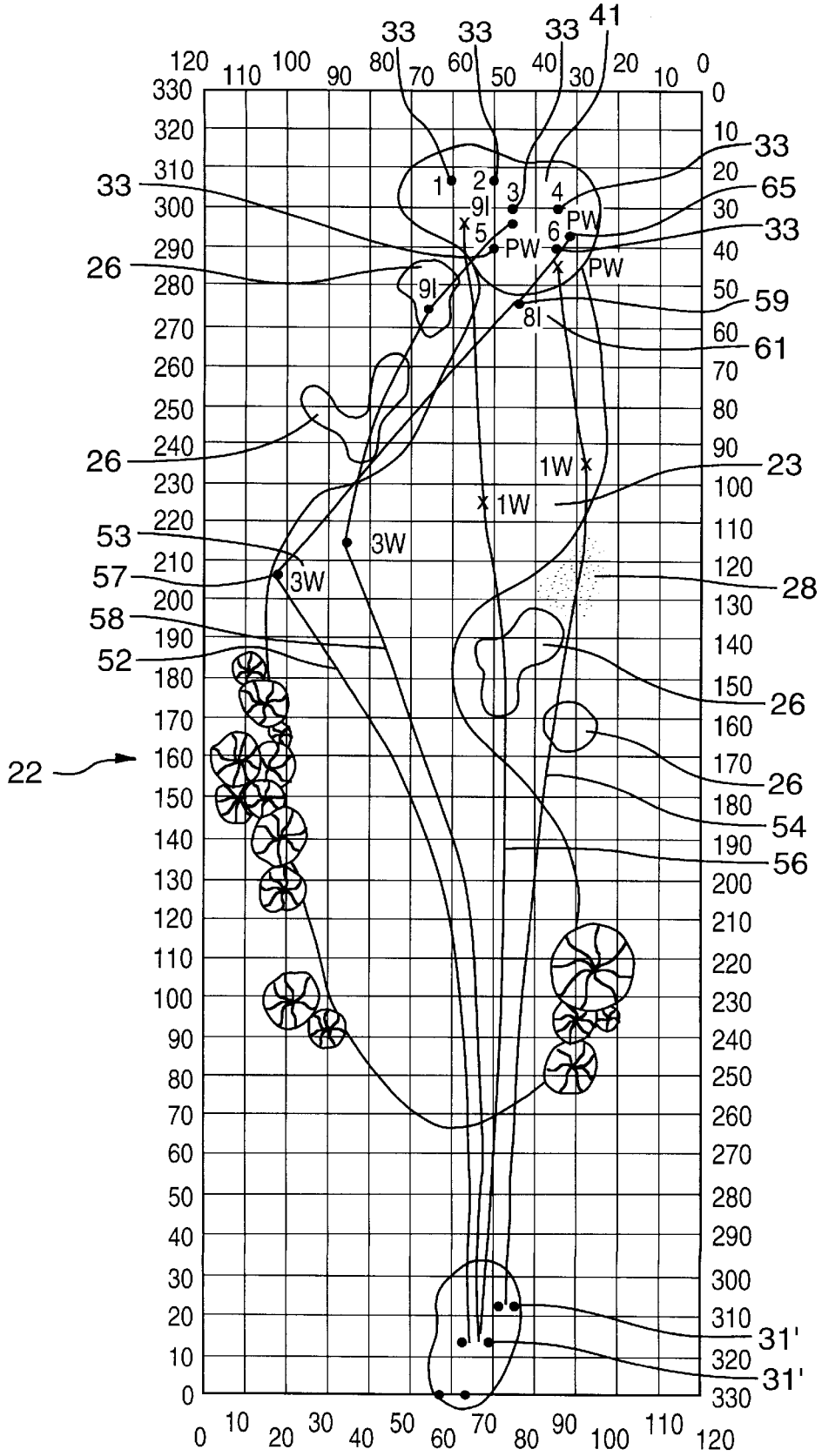
FIG. 2 of the drawings is a partial view of the map sheet of FIG. 1, showing an enlarged view of the first map depicting an aerial representation of the golf hole in use in accordance with the method of present invention.

The considerable advantages of the method of the present invention are realized during subsequent rounds of play on the same golf hole. In each subsequent instance of play, the golfer will have recorded the results of previous rounds, and can refer to this additional information in order to plan play for the present round of golf. FIG. 2 shows a representation of the first map showing the information which was recorded by the golfer during previous rounds of play. For subsequent rounds of play on the hole depicted in FIG. 2, the golfer would utilize the recorded landing points and flight paths of the golf ball for each previous round of play, together with the scaled rectilinear grid 30 in order to compensate for errors in golf club type selection and golf stroke encountered during previous rounds of play. In the example shown in FIG. 2, the golfer could deduce from flight paths 58 and 52, that on the tee shot he/she tends to hook the ball to the left when attempting to execute a long shot using his/her three wood. Other attempts at the tee shot, as shown by flight paths 54 and 56, show that he/she is able to make straighter shots for greater distance using the one wood. Using this combined information, the golfer should be in a position to make a better club selection and to guard against his/her tendency to hook the ball on long shots.

Similarly, as illustrated in FIG. 3, in putting situations, a golfer would record the particulars of putts on the second map 40, and in subsequent rounds of golf, refer not only to the finer scaled rectilinear grid 42, but also the recorded paths on previous putts to determine a desired putt. For example, as shown by reference numeral 60 in FIG. 3, a golf ball had previously initially landed 10 yards from the hole, and the golfer previously executed a putt the golf ball that broke left. The result being that the golfer did not properly judge the slopes of the green and it therefore resulted in a bad putt. The recorded path 60 marked on the second map 40 would then be used as a reminder of the slope features of that portion of the green in which the golfer miscalculated. On subsequent play, the golfer could adjust his/her putt to take that factor into account. Similarly, if a previous recorded putt path, such as path 62 show a tendency to putt too long, then the golfer could adjust for this tendency on subsequent putts.

By recording the particulars of each shot, including, the club used for each shot, ball landings of each shot, flight path and ball trajectory of each shot, score for each hole each time a course is played, pin placement, and other noteworthy comments the golfer wishes to make ("it was windy today" for example) on a particular hole and in turn, on the entire course, during repeated plays of the course, a golfer's game can be improved. Improvement is realized once a golfer uses the information and alters his/her game in some fashion (ex. using a different club or changing swing technique) and subsequently lowers the number of golf strokes required to complete play on each hole. Over repeated rounds of play at a particular course, a golfer can use the information from past games in order to improve club selection strategies, improve shot placement, and make changes to swing technique. "Swing technique" refers to the method which the golfer uses the golf club to deliver an impact upon the ball. The swing technique can be change by adjusting a golfer's grip, width of stance, wrist angles, back alignment, etc. A golfer can systematically develop his/her play by making adjustments to swing technique and recording the landing point and flight path of the ball using the golf distance indicator and stroke recording device, referring to the recorded paths during subsequent plays and making further small adjustments. The golfer can then detect if progress is being made from round to round.

In order to facilitate its continual practical use, the golf distance indicator and stroke recording device is preferably pocket sized, attachable to a golf bag, and all-weather resistant. To this end it may, for example, employ the use of waterproof and rewriteable surfacing, be rugged in construction, use an ultra-fine erasable felt-tipped marker and use UV protected ink. Information may be recorded in different symbolic forms, or colours, to distinguish different rounds of golf. After several rounds of play some or all of the recorded information can be erased, and the entire process repeated for further development of a golfer's game. A complete conventional scorecard for the course is preferably also incorporated in to the golf distance indicator and stroke recording device.

The golf distance indicator and stroke recording device can also be combined with advertising. The golf course, other businesses or interests can advertise itself in combination with this device in one complete booklet. Moreover, golfers can judge how they perform compared to professionals who have played the course. The golf distance indicator and stroke recording devices could be made available with markings thereon which show the flight paths and club selections of rounds of play by professional golfers. A golfer could then compare his/her game with that of a professional, to gain further insights into areas for improvement on a stroke-by-stroke basis throughout the course.

It will be apparent that the scope of the present invention is limited only by the claims set out hereinbelow.

We claim:

1. A method for improving golf play comprising, for each selected golf hole of a golf course played, the steps of:

(a) selecting a corresponding map sheet from a plurality of said map sheets being contained within a golf distance indicator and stroke recording device, each said map sheet correlated to a golf hole of a golf course and including, for said golf hole, a first map depicting an aerial representation of said golf hole and having a scaled rectilinear grid superimposed thereon, said grid identifying distances which correspond to true ground distances on said golf hole;

(b) estimating the distance and direction of a desired golf stroke sad distance being estimated with reference to the scaled rectilinear grid when said desired golf stroke is directed parallel to said scaled rectilinear grid, and, when said desired golf stroke is not directed parallel to said scaled rectilinear grid, with reference to an angular distance calculation means external to said first map which shows a calculated approximation of the distance of said desired golf stroke, said desired golf stroke being defined with reference to said first map;

(c) selecting a golf club appropriate to execute a golf stroke from a plurality of golf clubs each of a different type;

(d) executing the golf stroke utilizing the selected golf club and a golf ball;

(e) recording the landing point of said golf ball and an indicia of the type of golf club selected to execute the golf stroke of step (d), on the selected aerial representation of the golf hole.

2. The method of claim 1, wherein the angular distance calculation means comprises a table containing columns and rows of numerical values, which numerical values represent the Pythagorean sums of combinations of respective perpendicular and parallel distance vectors.

3. The method according to claim 2, further comprising the step of:

(f) repeating steps (b) through (e) until the golf ball is deposited into a cup at a pre-determined pin position on the selected golf hole played.

4. The method according to claim 3, further comprising the step of:

(g) for subsequent rounds of play on the selected golf hole, utilizing the respective recorded landing point of the golf ball, the indica of golf club type selected and used during the previous round of play on the selected golf hole, and the scaled rectilinear grid superimposed upon the aerial representation of the selected golf hole to select a golf club type and estimate the distance and direction of a subsequent golf stroke, so as to compensate for any errors in the golf club type selection and the golf stroke encountered during previous rounds of play, as evidenced by the recorded golf club type indicia and the flight path of the golf ball from previous rounds of play.

5. The method according to claim 1, wherein the recording step (e) is executed using an erasable drawing means.

6. The method according to claim 5, wherein the recording step (e) is executed using a different coloured erasable drawing means for each time a round of golf is played on a particular golf hole.

7. The method according to claim 1, wherein the recording step (e) comprises drawing the landing point of said golf ball on the aerial representation of the selected golf hole with reference to the scaled rectilinear grid.

8. The method according to claim 7, wherein the recording step (e) further comprises drawing the flight path, traveled by said golf ball to reach said landing point, on the aerial representation of the selected golf hole with reference to the scaled rectilinear grid.

9. The method according to claim 7, wherein the recording step (e) further comprises marking an alphanumeric indica of the selected golf club type on the aerial representation of the selected golf hole.

10. The method according to claim 1, comprising further step of:

(f') repeating steps (b) to (e) until the golf ball has landed on a putting green of the selected golf hole.

11. The method according to claim 10, comprising the further steps of:

(g') selecting a corresponding second map depicting an aerial representation of the putting green of the respective golf hole and having a second finer scaled rectilinear grid superimposed thereon in addition to the first scaled rectilinear grid, said second finer scaled rectilinear grid identifying distances which correspond to true ground distances on the putting green;

(h') using the second finer scaled rectilinear grid to estimate the distance and direction of a desired golf putt;

(i') executing the golf putt utilizing a selected club and the golf ball;

(j') recording the landing point and path of said golf ball and an indicia of the type of golf club selected to execute the golf putt of step (i') on the aerial representation of the putting green.

12. The method according to claim 11, comprising the further step of:

(k') repeating steps (h') through (j') until the golf ball is deposited into the cup at a pre-determined pin position on the selected golf hole played.

13. The method according to claim 12, comprising the further step of:

(l') for subsequent rounds of play on the putting green of the selected golf hole, utilizing the respective recorded landing points and paths of the golf ball, in addition to the second finer scaled grid superimposed upon the second aerial representation of the putting green, to estimate the distance and direction of a subsequent golf putt, so as to compensate for any putting errors recorded during previous rounds of play.

14. A method according to claim 1, further comprising the step of recording on the selected map sheet written comments respecting physical features or playing conditions of each selected golf hole for reference during subsequent rounds of play on said selected golf hole.

15. A golf distance indicator and stroke recording device comprising:

a plurality of map sheets correlated to a respective plurality of golf holes of a golf course, each said map sheet including, a first map depicting an aerial representation of a respective one of said plurality of the golf holes and having a first scaled grid superimposed thereon, said grid identifying distances which correspond to true ground distances on said golf hole; and, an angular distance calculation means external to said first map for showing a calculated approximation of the distance of a desired golf stroke, said desired golf stroke being defined with reference to said first map.

16. The golf distance indicator and stroke recording device of claim 15, further comprising representations of a plurality of possible pin placement positions on a putting green of said golf hole, on the first map depicting an aerial representation of the golf hole.

17. The golf distance indicator and stroke recording device of claim 16, further comprising representations, on the first map depicting an aerial representation of said golf hole, of each of a plurality of possible tee-off positions on the golf hole.

18. The golf distance indicator and stroke recording device of claim 17, further comprising on each said map sheet, a second map depicting an aerial representation of the putting green of said golf hole and having a second finer scaled grid superimposed thereon, in addition to and in synchronization with the first scaled grid, said second finer scaled grid identifying distances which correspond to true ground distances on the putting green.

19. The golf distance indicator and stroke recording device of claim 18, further comprising representations of each of a plurality of possible pin placement positions on said putting green, on the second map depicting an aerial representation of said putting green.

20. The golf distance indicator and stroke recording device of claim 15, wherein said aerial representation of the golf hole is an aerial photograph of said golf hole.

21. The golf distance indicator and stroke recording device of claim 18 wherein the angular distance calculation means comprises a table containing columns and rows of numerical values, which numerical values represent the Pythagorean sums of combinations of respective perpendicular and parallel distance vectors.

* * * * *